US006708875B2

(12) United States Patent
Cunningham

(10) Patent No.: US 6,708,875 B2
(45) Date of Patent: Mar. 23, 2004

(54) MAILBOX SIGNAL DEVICE

(76) Inventor: Ronald W. Cunningham, 1553 Williamstown Road, Franklinville, NJ (US) 08322

( * ) Notice: Subject to any disclaimer, the term of this patent is extended or adjusted under 35 U.S.C. 154(b) by 0 days.

(21) Appl. No.: 10/109,989

(22) Filed: Mar. 28, 2002

(65) Prior Publication Data

US 2003/0183682 A1 Oct. 2, 2003

(51) Int. Cl.[7] ..... B65D 91/00
(52) U.S. Cl. ..... 232/35; 116/215
(58) Field of Search ..... 232/35; 116/215

(56) References Cited

U.S. PATENT DOCUMENTS

| | | | | | |
|---|---|---|---|---|---|
| 2,807,410 | A | * | 9/1957 | Ward | 232/35 |
| 2,856,123 | A | * | 10/1958 | Mary | 232/35 |
| 3,212,701 | A | * | 10/1965 | Smith | 232/35 |
| 3,229,903 | A | * | 1/1966 | Smith | 232/35 |
| 3,709,189 | A | * | 1/1973 | Widham | 232/35 |
| 3,891,139 | A | * | 6/1975 | Redling | 232/35 |
| 4,344,559 | A | * | 8/1982 | Widham | 232/35 |
| 4,363,439 | A | * | 12/1982 | Manian | 232/35 |
| 4,382,542 | A | | 5/1983 | Farris | |
| 4,492,335 | A | | 1/1985 | Davis | |
| 4,655,390 | A | | 4/1987 | Martin | |
| 4,706,880 | A | * | 11/1987 | Peters | 232/35 |
| 4,708,286 | A | | 11/1987 | Norris | |
| 4,782,997 | A | | 11/1988 | Cotton, Jr. | |
| 4,821,953 | A | | 4/1989 | Poloha | |
| 4,877,180 | A | | 10/1989 | Shull | |
| 4,953,783 | A | | 9/1990 | Chambers | |
| 5,201,465 | A | * | 4/1993 | Limehouse | 232/35 |
| 5,284,295 | A | | 2/1994 | Steinfeldt | |
| 5,388,759 | A | | 2/1995 | Barnes | |
| 5,524,818 | A | * | 6/1996 | Patry et al. | 232/35 |
| 5,884,838 | A | * | 3/1999 | Rose | 232/35 |
| 5,927,596 | A | * | 7/1999 | Trenier | 232/35 |
| 6,065,671 | A | | 5/2000 | Stepleton | |
| 6,155,482 | A | | 12/2000 | Perry | |
| 6,318,629 | B1 | | 11/2001 | Anderson | |

FOREIGN PATENT DOCUMENTS

| | | |
|---|---|---|
| CA | 849923 | 8/1970 |

* cited by examiner

*Primary Examiner*—William L. Miller
(74) *Attorney, Agent, or Firm*—Barber Legal; Craig W. Barber

(57) ABSTRACT

An improved mail box signal comprises a case having a slide disposed therein. A catch on the slide engages a detent on the case interior and the slide hangs suspended from the detent when the case is in a substantially vertical orientation. When the case is rotated forward to a substantially horizontal position, the catch and detent disengage, freeing the slide to fall when the case is returned to the vertical. In embodiments, the device may allow the slide to partially project from the bottom of the case or may allow the slide to fall from the case, and/or hang suspended by a tether.

15 Claims, 2 Drawing Sheets

MAILBOX SIGNAL DEVICE

FIELD OF THE INVENTION

This invention relates to generally to curbside mailboxes and specifically to automatic indicator flags for mailboxes.

BACKGROUND OF THE INVENTION

Curbside mailboxes and newspaper boxes generally do not offer to their owners any convenient way to determine whether or not the mailboxes have any mail within them. The traditional flag which is lifted or lowered requires the cooperation of the delivery person and is often aligned parallel to the line of sight from the resident's home to the mailbox, making it harder to spot. As a result, various inventions have been patented which offer devices aimed at automatically registering the presence of mail or newspapers in the curbside box.

U.S. Pat. No. 6,318,629 B1 issued Nov. 20, 2001 to Anderson for "SIGNAL DEVICE FOR MAILBOX" teaches a signal device that is secured between the body and door of the mailbox, falling forward when the mailbox door is opened.

U.S. Pat. No. 6,155,4482 issued Dec. 5, 2000 to Perry for "MAIL DELIVERY SIGNAL KIT AND METHOD OF USE" teaches a magnet retrofitted to a mailbox door, and a flag system which falls away from the magnet when the door is opened.

U.S. Pat. No. 6,065,671 issued May 23, 2000 to Stepleton for "ROADSIDE MAILBOX DELIVERY SIGNAL" teaches a flag inclined by gravity to rise but prevented from doing so by a tip which is trapped between the body and door of the mailbox. When the mailbox door is opened, the tip is released and the flag pivots upright.

U.S. Pat. No. 5,388,759 issued Feb. 14, 1995 to Barnes for "DELIVERY SIGN FOR A RURAL MAILBOX" teaches a Venetian blind attached to a pendulous weight: when the mailbox door is opened, the weight falls forward, opening the venetian blind to reveal a message indicating that mail has arrived.

U.S. Pat. No. 5,284,295 issued Feb. 8, 1994 to Steinfeldt for "MAILBOX DELIVERY SIGNAL DEVICE" teaches a signal ball attached to a tether. The ball rests upon a shelf projecting from the door of the mailbox, when the door is opened, the ball falls off and hangs suspended by the tether.

U.S. Pat. No. 4,953,783 issued Sep. 4, 1990 to Chambers for "MAILBOX SIGNAL DEVICE" teaches a flag secured in a detent or rest in the door. When the door is opened, the flag falls.

U.S. Pat. No. 4,877,180 issued Oct. 31, 1989 to Shull for "MAILBOX SIGNALLING APPARATUS" teaches a base for supporting a mailbox. When the door of the mailbox opens, a plate in the base is pushed towards the rear of the mailbox and actuating means release two flags to fall.

U.S. Pat. No. 4,821,953 issued Apr. 18, 1989 to Poloha for "MAILBOX GRAVITY SIGNALLING APPARATUS" teaches a tethered flag having a ring or hole which fits over a support arm on the mailbox door. When the door is opened, the flag slides off of the arm and hangs below the box.

U.S. Pat. No. 4,782,997 issued Nov. 8, 1988 to Cotton, Jr. for "MAIL DELIVERY SIGNAL DEVICE" teaches a flag similar to that of the '783 patent in that it rests wedged between the door and body of the mailbox when the door is closed, falling free when the door is opened.

U.S. Pat. No. 4,708,286 issued Nov. 24, 1987 to Norris for "MAIL-CALL SIGNAL DEVICE" teaches a name plate and signal plate. The name plate is hinged at its top edge to the door of the mailbox and at its bottom edge to the top edge of the signal plate. The signal plate rests folded up behind the name plate until the door is opened, at which point the signal plate falls forward, freeing the signal plate to fall free therefrom.

U.S. Pat. No. 4,655,390 issued Apr. 7, 1987 to Martin for "MAILBOX SIGNAL DEVICE" teaches a flag hinged at its base edge and attached to the door of the mailbox. The flag rests approximately vertically (possibly held by a loose clip at the top edge) and falls free when the door is opened.

U.S. Pat. No. 4,492,335 issued Jan. 8, 1985 to Davis for "MAILBOX SIGNALING DEVICE" teaches a flag which is released by the delivery person prior to opening the mailbox door.

U.S. Pat. No. 4,382,542 issued May 10, 1983 to Farris for "MAIL SIGNAL APPARATUS" teaches a flag hinged at its lower edge to the door and held at its upper side by a latch or weight. When the door is opened, the weight swings free, releasing the flag to also swing freely.

Finally, Canadian Patent 849,923 issued Aug. 25, 1970 to Duffey for "AUTOMATIC MAIL SIGNAL FOR MAIL BOXES" teaches a flag hinged to sit parallel to the bottom surface of the box. A friction joint holds the flag in this position until the door of the mailbox is opened and the flag is forced against the bottom of the mailbox and then into a new angular relationship with the door. When the door is closed, the flag remains in the new position in relationship to the door.

With the exception of the Barnes '759 patent, each of the references cited above leaves the mechanism of the flag exposed to the elements, in which location it is easy for the mechanism to become ice encrusted or snowbound, causing the mechanism to not work. In addition, these devices allow the flag/signal device to become coated with snow and thus considerably less visible. Certain of these devices additionally only present easy viewing conditions from one side or the other.

The Barnes '759 patent requires a window which is angled to the vertical (the space behind the window being necessary for the pendulous weight) and thus presents another surface which may easily become ice or snow encrusted. In that event, the device might work perfectly but still not be easily visible. In addition, the device of the '759 patent is only visible from a single direction, the front of the mailbox. While some "rural" style (curbside or roadside) boxes are positioned across a street from the owner's viewing position, many are in front of the viewing position (typically house or drive) and thus may not benefit from the device of the '759 patent under any circumstances. The mechanical complexity of the '759 is also a disadvantage of production and use.

It would be beneficial to provide an improved automatic mail box flag visible from either side of a mailbox yet protected from the elements.

SUMMARY OF THE INVENTION

General Summary

The present invention provides an improved mail box signal having a case and a slide mounted within the case. The case has a detent and the slide a conforming catch such that when the case is vertical, the slide may be held suspended substantially or entirely within the case. The case is mounted upon the door of a curbside mailbox and when the door is opened, the case is rotated to the horizontal. In the horizontal position, the catch falls free from the detent, freeing the slide to drop substantially or entirely free from the case under the influence of gravity. In the preferred embodiment, the slide may drop vertically "straight" out of the open bottom of the case. In alternative embodiments, the slide may pivot either in a track, or about a pivot, or by other means, and thus fall partially out one side of the case, or out of the case on both one side and the bottom.

The invention may be easily retrofitted to existing curbside mailboxes, however, it may with equal facility be incorporated into new mailboxes as well.

In an alternative embodiment, the slide may have brightly colored flags on one or both sides, so as to improve visibility thereof.

In another embodiment, the case may have a clear pane having a flag behind it, such that when the slide is positioned within the case the interior flag is obscured, but when the slide falls, the interior flag is displayed.

In yet another embodiment, the interior flag or the flags on the slide may be insignia such as the US flag, sports team insignia, trademarks or service marks, advertising for consumer products and so on.

In yet another embodiment of the invention, the case and/or stop may have a second stop located at the bottom of the case in order to prevent the slide from falling entirely free of the case: the slide will halt with a top portion of the slide still within the case. In another aspect, the invention may provide a pull or handle on the slide to allow easy manipulation thereof by the user. In another aspect, the invention may provide a track or slot cooperating with the pull or handle to both allow easy manipulation of the slide and to prevent the slide from falling entirely clear of the case.

In yet another embodiment of the invention, the slide may have a tether to hold it suspended in the air after falling free from the case.

In yet another embodiment of the invention, the case may have one or more fastenings selected from the group consisting of adhesives, nails, screws, bolts, magnets, welds, frames or equivalent devices to allow easy and/or secure placement of the device on the mailbox door.

Summary Based Upon the Claims

The present invention teaches a mailbox signal comprising: a case having an interior and an exterior, and having a detent in the interior; a slide disposed within the interior of the case, the slide having a catch dimensioned and configured to engage the detent when the case is in a substantially vertical orientation; the slide suspended by the detent when so engaged; the interior being large enough that when the case is rotated, the catch is disengaged from the detent and the slide may fall.

The present invention also teaches the mailbox signal further comprising: an aperture through the case, located, dimensioned and configured so that when the slide falls, the slide projects at least partially from the case.

The present invention also teaches that the mailbox signal may further comprise: at least one flag on the slide or a plurality of flags on the slide.

The mailbox signal may further comprise: a clear panel of the case, dimensioned and configured to allow a visible determination of whether the slide has fallen or is suspended from the detent.

The mailbox signal in further aspects comprises: a flag located in the interior of the case behind the slide when the slide is suspended from the detent but visible through the clear panel when the slide has fallen.

The mailbox signal in further advantages may comprise: a slot through the case.

The mailbox signal in further embodiments may comprise: a handle affixed to the slide and projecting through the slot.

It is a further objective of the present invention to provide a mailbox signal further comprising: a stop disposed across the slot to limit the downward motion of the handle.

The mailbox signal may further comprise: a stop disposed within the slot to limit the downward motion of the handle.

The mailbox signal may further comprise: a tether having two ends and having a first end attached to the slide.

The mailbox signal further teaches: an attachment of the second end of the tether to the case.

The mailbox signal may further comprise: an attachment of the second end of the tether to the mailbox.

The mailbox signal in further aspects, advantages and objectives teaches: a fastener allowing the case to be attached to such mailbox.

The mailbox signal further teaches that the fastener is one member selected from the group comprising: glue, tape, adhesive, nail, tack, screw, bolt, magnet, clamp, wire, spring and weld.

The present invention further teaches a method of displaying an insignia, comprising: affixing the device of the present invention to a door of such mail box, suspending the slide from the detent, and allowing a delivery person to open the door of such mailbox. The insignia may be one member selected from the group comprising: national flags, flags, seals, emblems, religious symbols, advertisements, trademarks, service marks, sports team insignia, patches, marks, news media identification marks, coats of arms, and medals.

DETAILED DESCRIPTION

Figure 1:
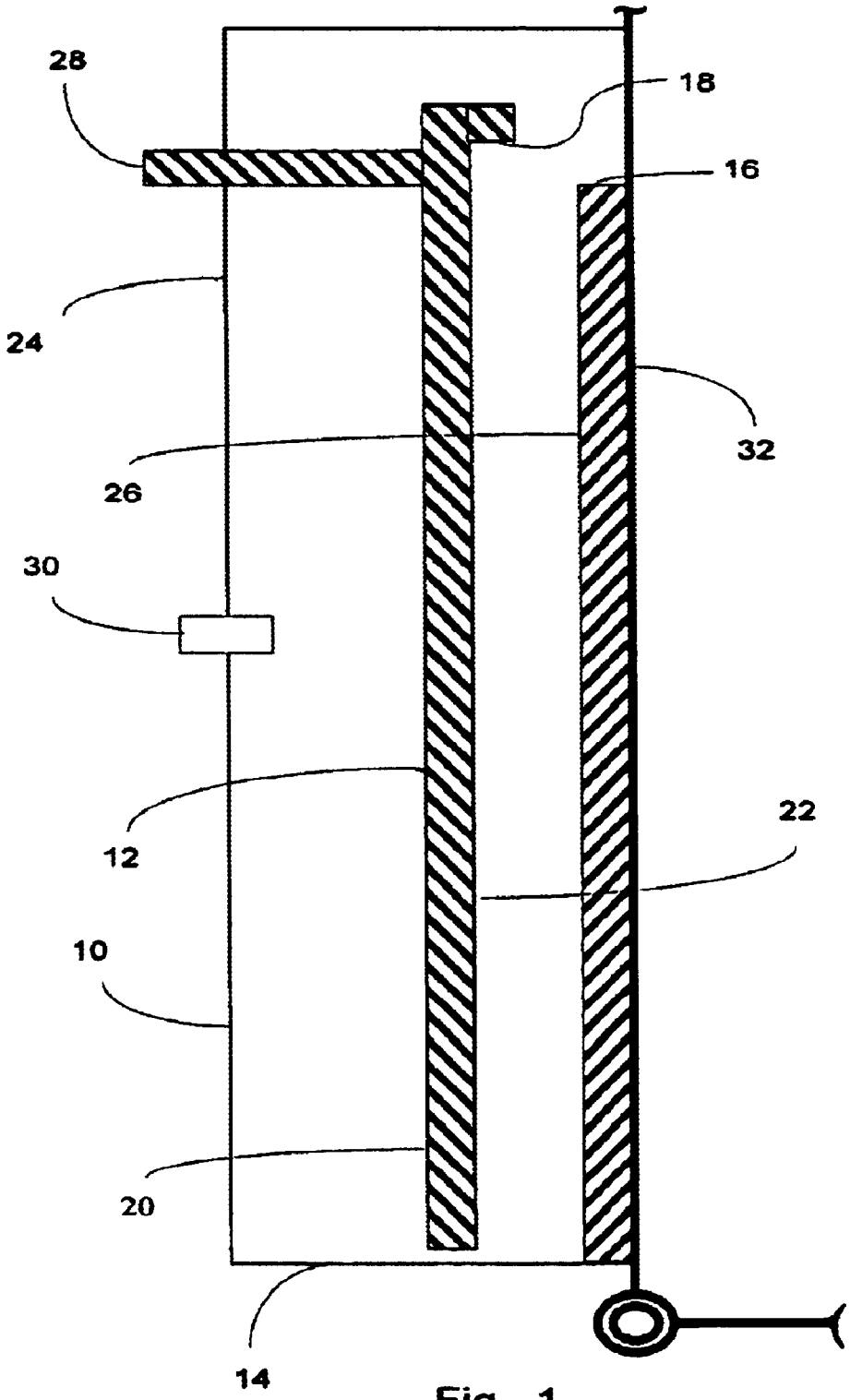
FIG. 1 is a cross sectional view of the preferred embodiment and best mode presently contemplated for carrying out the invention, simplified by having the thickness of the invention's case disregarded, showing the invention at a time when the slide is being deployed.

FIG. 1 is a cross sectional view of the preferred embodiment and best mode presently contemplated for carrying out the invention, simplified by having the thickness of the invention's case disregarded, showing the invention at a time when the slide is being deployed.

Case 10 holds slide 12 loosely contained therein. Bottom 14 of case 10 is partially or wholly open, allowing slide 12 to fall partially or wholly out of case 10. Slide 12 may be secured in case 10 by placing catch 18 on detent or shelf 16, thus supporting the weight of slide 12.

In the illustration, case 10 is depicted as having little or no thickness, however, the thickness of case 10 may be varied as circumstances indicate. It is important, however, that there is enough space inside of case 10 for slide 12 to either rest (by means of catch 18) on detent 16 or else to fall forward off of shelf 16 and then slide freely downwards, wholly or partially through bottom 14.

The lower portion of slide 12 may advantageously be equipped with flags 20 and/or 22. Thus, when slide 12 falls, flags 20, 22 will be exposed to view of the mail box user. Additionally, in the preferred embodiment and best mode presently contemplated, case 10 has clear panel 24. Slide 12 is visible through clear panel 24 when slide 12 is raised. After activation, slide 12 descends and interior flag position 26 becomes visible. This provides a third location for an indicator flag.

Handle 28 projects through slot 36 (not visible in FIG. 1) to allow easy manipulation of slide 12. By means of handle 28, the user may conveniently replace slide 12 in it's pre-activation position. In addition, in the presently preferred embodiment handle 28 may function with adjustable stop 30 to prevent slide 12 from entirely departing case 10. Stop 30 may positioned across the slot or within it, or at other equivalent locations.

Finally, fastener site 32 (in the preferred embodiment this is the back of case 10) may advantageously be used for a fastener (not pictured) to hold case 10 to the door of a mailbox. The fastener may be glue, a tacky or gummy adhesive, tape, magnets, screws, nails, bolts, tacks, clamps, wires, springs, welds and so on. Fastener site 32 need not be only the back of case 10 but may be the side or top of case 10 or other equivalent location. A loop for a nail, screw, bolt or tack may be provided, an adhesive pad or a spot of adhesive may be provided, and other similar fastener sites and fasteners may be used without departing from the scope of the invention as claimed herein.

In operation, catch 18 sits on detent 16, holding slide 12 in place inside of case 10. Flags 20, 22 and interior flag position 26 are not visible: flags 20 and 22 are inside of case 10 while interior flag position 26 is obscured by slide 12. At such times, case 10 is in a substantially vertical orientation on the front of a delivery box door.

At the time that a delivery is made to the newspaper or mail box having the invention attached to the door, the door is opened, swinging the door and the invention forward and rotating the invention from a substantially vertical alignment to a substantially or partially horizontal orientation. If the rotation is slow enough, catch 18 may slide forward off of shelf 16 while slide 12 is still able to slide downwards, partially or entirely departing case 10 through bottom 14. More usually, the mailbox door will be opened quickly, and catch 18 will slide off of shelf 16, as the invention reaches a substantially horizontal position which prevents slide 12 from descending immediately. In that event, the position shown in FIG. 1 will result: catch 18 will be free of detent 16 but slide 12 will not have then descended. At the time that the delivery person raises the door of the mailbox, case 10 will begin to return to the vertical and slide 12 will descend, resulting in proper functioning of the device, regardless of the speed of operation.

The operative features of the device are very reliable: there is no complex shutter system, the weight and balance considerations are very simple and the operation depends upon a single moving part. The device is also simple and thus inexpensive to manufacture as well as being easy to install. While metal parts may be incorporated into the device, there is no need to make any component of metal, thus preventing corrosion or rust. As there are no springs, there is no chance of fatigue or weakening.

It is worth noting that the operative equipment of the device is contained substantially within case 10, rendering the device almost immune to weather induced problems. Only handle 28 projects from case 10 through the slot, and handle 28 may be omitted in other embodiments of the invention. In such embodiments, slide 12 may be grasped and inserted to reseat catch 18 onto detent 16 or other arrangements may be provided for resetting the device. Resetting this embodiment of the device requires only one hand, not two, a simplification which will be appreciated by any user having one hand full of mail. In such embodiments, an optional stop (not pictured) may be provided at bottom 14 to engage catch 18 and prevent slide 12 from entirely departing from case 10. In another alternative embodiment of the invention, slide 12 may be allowed to depart from case 10. In yet another alternative embodiment of the invention, slide 12 may be secured by a tether (not pictured) to allow the desired amount of motion on the part of slide 12. The tether may be internal or external and may allow slide 12 only to partially depart case 10 or may allow slide 12 to entirely depart case 10.

In another alternative embodiment of the present invention, case 10 may have no aperture at the bottom, so that slide 12 falls entirely within case 10 and only interior flag position 26 is exposed to view.

The device is also safer than many prior art designs, as there is very little to project from the mailbox. Known designs have included flags which project vertically or horizontally and thus may catch, snag or poke the body or clothing of passers by.

Figure 2:
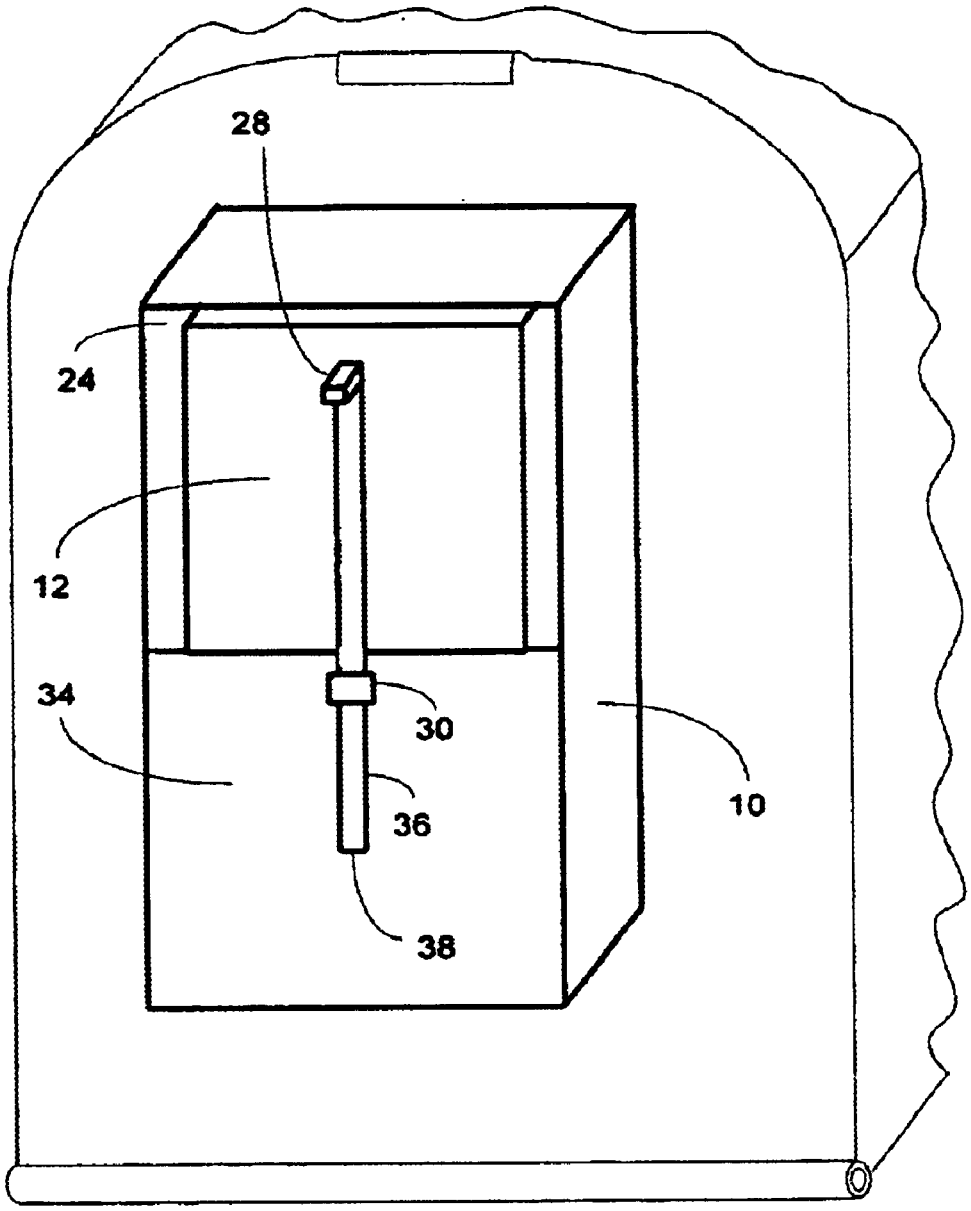
FIG. 2 is a perspective view of the same embodiment of the invention shown in FIG. 1, showing the manner in which the slide is visible through the clear panel of the case.

FIG. 2 is a perspective view of the same embodiment of the invention shown in FIG. 1, showing the manner in which the slide is visible through the clear panel of the case.

Colored (rather than transparent) case 10 has slide 12 in the "ready" or raised position. Clear panel 24 allows the top portion of slide 12 to be seen from the outside of case 10, however, interior flag position 26 is obscured by slide 12. Thus the upper portion of slide 12 may advantageously be made the same color as case 10 while the lower portion of slide 12 is a bright flag. Panel 34 may advantageously be the same color as case 10, thus obscuring the lower portion of slide 12. With such a color scheme, the entire device may present one color scheme when raised and yet show several bright or eye catching flags when activated.

Stop 30 may be adjustable, allowing the user to select the degree of motion desired for slide 12. Alternatively, stop 30 may be omitted, and slot 36, rather than being continuous, may have a bottom end 38 which may act as a stop.

The present invention may also be advantageously used to display specific insignia. While the references heretofor in this application to "flags" refer to any signal of any color scheme (for example, "Day Glo" Orange, other bright colors, flourescent colors, or glow in the dark colors) the invention is not so limited. Specific insignia may be used as the various flags.

Examples of such insignia include the United States Flag, flags of the various states and other governmental bodies, flags, patches and seals associated with particular branches or arms of the U.S. Government such as the Marine Corps seal, insignia associated with religious observances, insignia of sports teams, commercial or consumer products and services, news organizations such as newspapers or magazines, trademarks, service marks, individual insignia, coats of arms, etc. In general, any flag, device, insignia, patch, medal, mark, or other item may be displayed. Such display may be voluntary or for profit.

Interior flag position 26 is protected from the elements and thus may advantageously display insignia for which wear and tear is undesirable, such as the United States Flag.

Temporary display may be arranged, for example, flags 20, 22 or interior flag position 26 may be detachable, or special securing devices (frames, tape, or any other members of the list previously enumerated for securing of the invention to a mailbox door) may be used in other embodiments. The invention may be easily partially or wholly disassembled for easy changing of the displayed insignia, or, as in the presently preferred embodiment, the device may be sold as a unit without any internal access offered.

The slide may comprised of a flexible material, so as to prevent it from breaking if it comes into contact with other parts of the mailbox. As previously discussed, there are other methods of avoiding the problem of having the slide break when the door is opened if that opening motion should happen to bring the slide into contact with the post supporting the mailbox. In the preferred embodiment, the slide may drop vertically out of the open bottom of the case. In alternative embodiments, the slide may pivot either in a track, or about a pivot, or by other means, and thus fall partially out one side of the case, or out of the case on both one side and the bottom. When the slide falls and ends up protruding from the side of the case, there is no danger of hitting the support post when the door is opened. In the embodiment adverted to earlier in which the slide falls entirely free of the case (remaining attached only by a tether) this problem is also eliminated.

The invention may be easily retrofitted to existing curbside mailboxes, however, it may with equal facility be incorporated into new mailboxes as well.

Any or all of the unit may be ultraviolet resistant, so as to increase lifespan.

The term "mailbox" in the appended claims refers not only to traditional "rural", "roadside" or "curbside" mailboxes but also to newspaper boxes and other forms of delivery boxes.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A mailbox signal comprising:

a) a case having an interior and an exterior, and having a detent in the interior;

b) a slide disposed within the interior of the case, the slide having a catch dimensioned and configured to engage the detent when the case is in a substantially vertical orientation; the slide suspended by the detent when so engaged;

c) the interior being large enough that when the case is rotated, the catch is disengaged from the detent and the slide may fall, the case further comprising a clear panel, dimensioned and configured to allow a visible determination of whether the slide has fallen or is suspended from the detent.

2. The mailbox signal of claim 1, further comprising:

d) an aperture through the case, located, dimensioned and configured so that when the slide falls, the slide projects at least partially from the case.

3. The mailbox signal of claim 1, further comprising:

e) at least one flag on the slide.

4. The mailbox signal of claim 1, further comprising:

f) a plurality of flags on the slide.

5. The mailbox signal of claim 1, further comprising:

h) a flag located in the interior of the case behind the slide when the slide is suspended from the detent but visible through the clear panel when the slide has fallen.

6. The mailbox signal of claim 1, further comprising:

m) a tether having two ends and having a first end attached to the slide.

7. The mailbox signal of claim 6, further comprising:

n) an attachment of the second end of the tether to the case.

8. The mailbox signal of claim 6, further comprising:

o) an attachment of the second end of the tether to the mailbox.

9. The mailbox signal of claim 1, further comprising:

p) a fastener allowing the case to be attached to a mailbox.

10. The mailbox signal of claim 9, wherein the fastener is one member selected from the group comprising: glue, tape, adhesive, nail, tack, screw, bolt, magnet, clamp, wire, spring and weld.

11. A mailbox signal comprising:

a case having b) an interior and c) an exterior, and having d) a detent in the interior;

e) a slide disposed within the interior of the case, f) the slide having a catch dimensioned and configured to engage the detent when the case is in a substantially vertical orientation;

g) the slide suspended by the detent when so engaged;

h) the interior being large enough that when the case is rotated, the catch is disengaged from the detent and the slide may fall, i) a vertical slot through the case, j) a handle affixed to the slide and projecting through the slot.

12. The mailbox signal of claim 11, further comprising:

k) a stop disposed across the slot to limit the downward motion of the handle.

13. The mailbox signal of claim 11, further comprising:

l) an adjustable stop disposed within the slot to limit the downward motion of the handle.

14. A method of displaying an insignia on a mailbox having a door, the method comprising:

a) affixing a mailbox signal to the door of the mail box, the mailbox signal comprising:

a1) a case having an interior and an exterior, and having a detent in the interior;

a2) a slide disposed within the interior of the case, the slide having a catch dimensioned and configured to engage the detent when the case is in a substantially vertical orientation; the slide suspended by the detent when so engaged;

a3) the interior being large enough that when the case is rotated, the catch is disengaged from the detent and the slide may fall, exposing the insignia, b) suspending the slide from the detent, and c) allowing a delivery person to open the door of the mailbox.

15. The method of insignia display of claim 14, wherein the insignia is one member selected from the group comprising: national flags, flags, seals, emblems, religious symbols, advertisements, trademarks, service marks, sports team insignia, patches, marks, news media identification marks, coats of arms, and medals.

* * * * *